US011649636B2

(12) United States Patent
Shearer

(10) Patent No.: US 11,649,636 B2
(45) Date of Patent: May 16, 2023

(54) TUBULAR MOTOR SEAL FOR EXTENDABLE AWNING

(71) Applicant: Taylor Made Group, LLC, Gloversville, NY (US)

(72) Inventor: Robert R. Shearer, Bradenton, FL (US)

(73) Assignee: TAYLOR MADE GROUP, LLC, Gloversville, NY (US)

( * ) Notice: Subject to any disclaimer, the term of this patent is extended or adjusted under 35 U.S.C. 154(b) by 266 days.

(21) Appl. No.: 16/597,041

(22) Filed: Oct. 9, 2019

(65) Prior Publication Data

US 2020/0109566 A1 Apr. 9, 2020

Related U.S. Application Data

(60) Provisional application No. 62/743,056, filed on Oct. 9, 2018.

(51) Int. Cl.
*E04F 10/06* (2006.01)
*E06B 9/70* (2006.01)

(52) U.S. Cl.
CPC ..... *E04F 10/0666* (2013.01); *E06B 9/70* (2013.01)

(58) Field of Classification Search
CPC ..... E04F 10/0666; E04F 10/0685; E04F 10/0659; E04F 10/0648; E04F 10/10; E06B 9/70; E06B 9/72; E06B 9/50; H02K 5/10
See application file for complete search history.

(56) References Cited

U.S. PATENT DOCUMENTS 4,211,152 A 7/1980 Colletti et al.
4,751,953 A * 6/1988 Appel ..... E06B 9/50 160/313
4,927,988 A 5/1990 Nolte
4,955,793 A 9/1990 Caoduro
5,123,474 A 6/1992 Smith
5,378,121 A 1/1995 Hackett
5,522,601 A * 6/1996 Murphy ..... F16J 15/4478 277/421

(Continued)

FOREIGN PATENT DOCUMENTS

CN 106471204 A * 3/2017 ..... H01R 13/5219
DE 102008026960 A1 * 12/2009 ..... E06B 7/086

(Continued)

OTHER PUBLICATIONS

Lacker, DE 102008026960 machine translation, Oct. 2009, retrieved from https://worldwide.espacenet.com/publicationDetails/biblio?II=0&ND=3&adjacent=true&locale=en EP&FT=D&date=20091210&CC=DE&NR=102008026960A1&KC=A1 (Year: 2009).*

*Primary Examiner* — Abe Massad
(74) *Attorney, Agent, or Firm* — Nixon & Vanderhye P.C.

(57) ABSTRACT

A seal enclosure protects a tubular motor that is configured to drive an awning roller. The seal enclose includes a motor box sized to fit over an end of the tubular motor, a motor box extension engaging the motor box and including a circumferential protrusion, a gasket positioned between the motor box and the motor box extension, and a flexible seal engaging the circumferential protrusion and configured to engage the awning roller. The motor box, the motor box extension and the flexible seal define a closed housing for the tubular motor.

14 Claims, 4 Drawing Sheets

(56) References Cited

U.S. PATENT DOCUMENTS 6,129,529 A 10/2000 Young et al.
6,695,033 B1 * 2/2004 Simon ..... E06B 9/13 160/133
6,843,301 B2 * 1/2005 Carrillo ..... E04F 10/0614 160/310
7,207,786 B2 4/2007 Grant
7,264,494 B2 9/2007 Kennedy et al.
7,632,124 B2 12/2009 Kennedy et al.
7,726,997 B2 6/2010 Kennedy et al.
7,857,604 B2 12/2010 Shaw et al.
8,651,836 B2 2/2014 Parmeter et al.
8,698,022 B2 4/2014 Kawakami
8,869,870 B2 * 10/2014 Wieczorek ..... B60J 1/2013 160/370.22
9,000,643 B2 4/2015 Kino
9,175,692 B2 11/2015 Nowitzki et al.
9,373,986 B2 6/2016 Quade et al.
9,945,377 B2 4/2018 Pippes et al.
10,502,004 B2 12/2019 Knapp et al.
10,947,737 B2 * 3/2021 Meyers ..... E04F 10/0614
11,230,883 B2 * 1/2022 Sonzini ..... H02K 5/22
2005/0103450 A1 * 5/2005 Beau ..... E06B 9/72 160/168.1 R
2008/0093030 A1 * 4/2008 Gutierrez ..... E04F 10/0696 160/67
2010/0244602 A1 * 9/2010 Perret ..... H02K 5/161 310/90
2010/0251538 A1 * 10/2010 Spaggiari ..... H02K 15/14 29/596
2013/0092333 A1 * 4/2013 Malausa ..... E06B 9/72 160/368.1
2013/0126107 A1 * 5/2013 Feldstein ..... E06B 9/70 160/310
2013/0276995 A1 * 10/2013 Mullet ..... E06B 9/72 160/310
2014/0009042 A1 * 1/2014 Cavarec ..... H02K 1/14 310/67 R
2015/0330086 A1 * 11/2015 Taylor ..... E04F 10/0648 160/69
2016/0156248 A1 * 6/2016 Lueker ..... E06B 9/70 310/83
2018/0291682 A1 * 10/2018 Walter-Seifart ..... E06B 9/68
2020/0308907 A1 * 10/2020 Brondex ..... E06B 9/50

FOREIGN PATENT DOCUMENTS

FR 2616418 A1 * 12/1988 ..... B65G 23/08
FR 2904152 A1 * 1/2008 ..... H01R 24/66
FR 2941008 A1 * 7/2010 ..... E06B 9/174
WO WO-2017211997 A1 * 12/2017 ..... E06B 9/72

* cited by examiner

TUBULAR MOTOR SEAL FOR EXTENDABLE AWNING

CROSS-REFERENCES TO RELATED APPLICATIONS

This application claims the benefit of U.S. Provisional Patent Application No. 62/743,056, filed Oct. 9, 2018, the entire content of which is herein incorporated by reference.

STATEMENT REGARDING FEDERALLY SPONSORED RESEARCH OR DEVELOPMENT (Not Applicable)

BACKGROUND

The invention relates to a tubular motor for driving an awning roller and, more particularly, to a seal enclosure for a tubular motor.

Typical lateral arm awnings incorporating tubular type motors use a tubular motor attached to a roll-up tube that has a limited Ingress Protection rating (IP code). The use of a motor with a limited Ingress Protection rating in an outdoor environment can lead to premature failure of the motor due to corrosion and the like.

SUMMARY

The seal enclosure according to the described embodiments utilizes a rotary seal, motor box, motor box/seal interface, and roll-up tube gasket to interface with the tubular motor and roll-up tube assembly to increase the Ingress Protection rating while still allowing for normal operation. The assembly seals the tubular motor from the elements to prevent corrosion that could occur with a typical residential lateral awning. The rotary seal and connector elements allow the tube to rotate about the connector element and provide a water resistant seal.

In an exemplary embodiment, a seal enclosure for a tubular motor includes a motor box having an exterior shape and sized to fit over an end of the tubular motor, and a motor box extension having an outer shape corresponding to the exterior shape and engaging the motor box, where the motor box extension includes a circumferential protrusion. A gasket is positioned between the motor box and the motor box extension, and a flexible seal engages the circumferential protrusion and is configured to engage the awning roller.

The motor box extension may include a first central opening that is sized to fit over the awning roller. The gasket may include a second central opening that is sized corresponding to the first central opening. The gasket may have an outer shape corresponding to the exterior shape of the motor box. The circumferential protrusion may be disposed around an exterior surface of the motor box extension. The circumferential protrusion may include an inclined surface, and the motor box extension may further include a trough on a motor box side of the circumferential protrusion. The flexible seal may include an interior circumferential ridge, where the interior circumferential ridge is positioned over the inclined surface into engagement with the trough.

In another exemplary embodiment, a motorized awning roller assembly includes an awning roller, a tubular motor coupled with the awning roller to drive the awning roller, and the seal enclosure of the described embodiments.

In yet another exemplary embodiment, a seal enclosure includes a motor box sized to fit over an end of the tubular motor, a motor box extension engaging the motor box and including a circumferential protrusion, a gasket positioned between the motor box and the motor box extension, and a flexible seal engaging the circumferential protrusion and configured to engage the awning roller. The motor box, the motor box extension and the flexible seal define a closed housing for the tubular motor.

BRIEF DESCRIPTION OF THE DRAWINGS

These and other aspects and advantages will be described in detail with reference to the accompanying drawings, in which.

DETAILED DESCRIPTION

Figure 1:
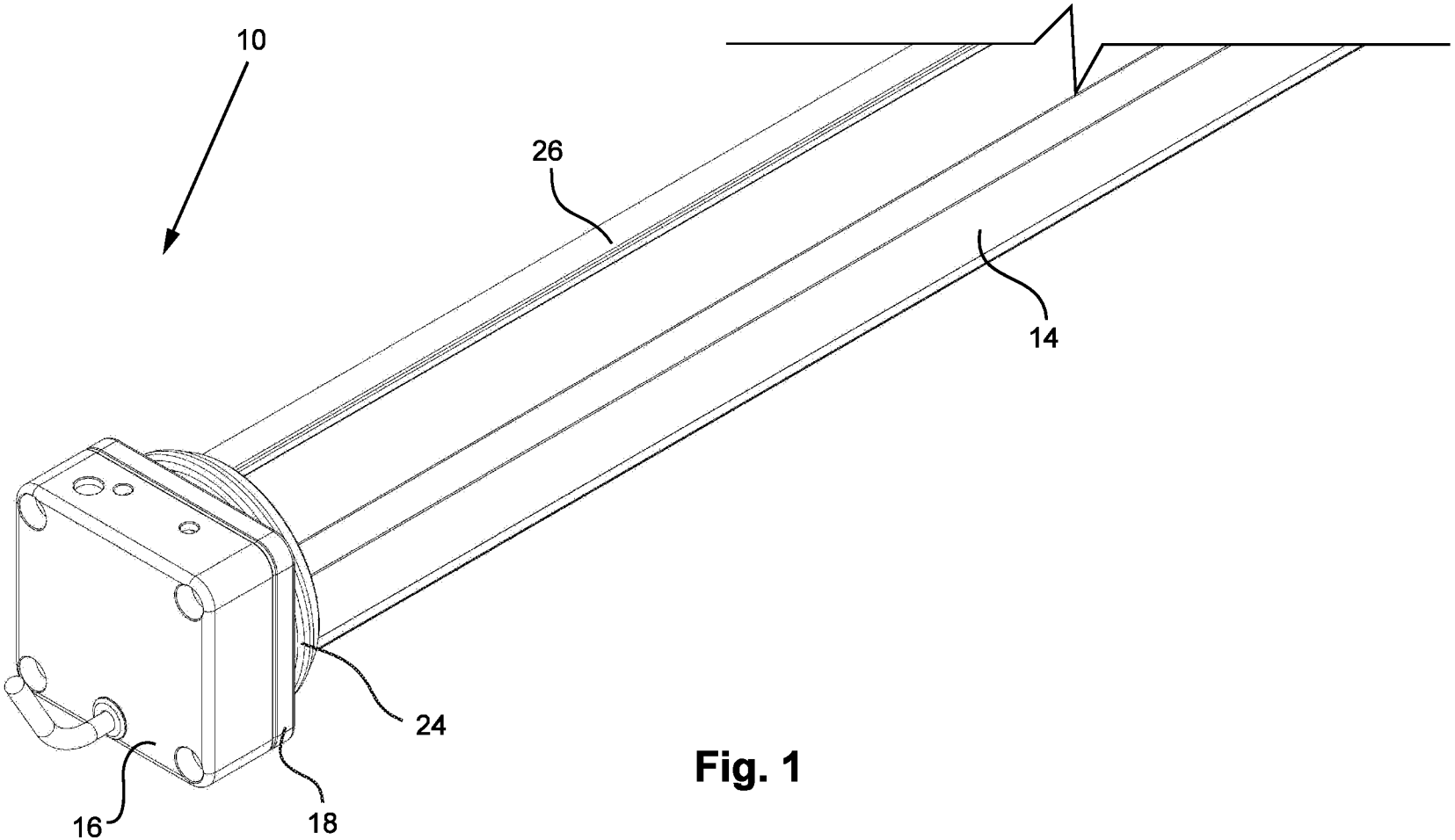
FIG. 1 is a perspective view of the seal enclosure according to the described embodiments.
Figure 2:
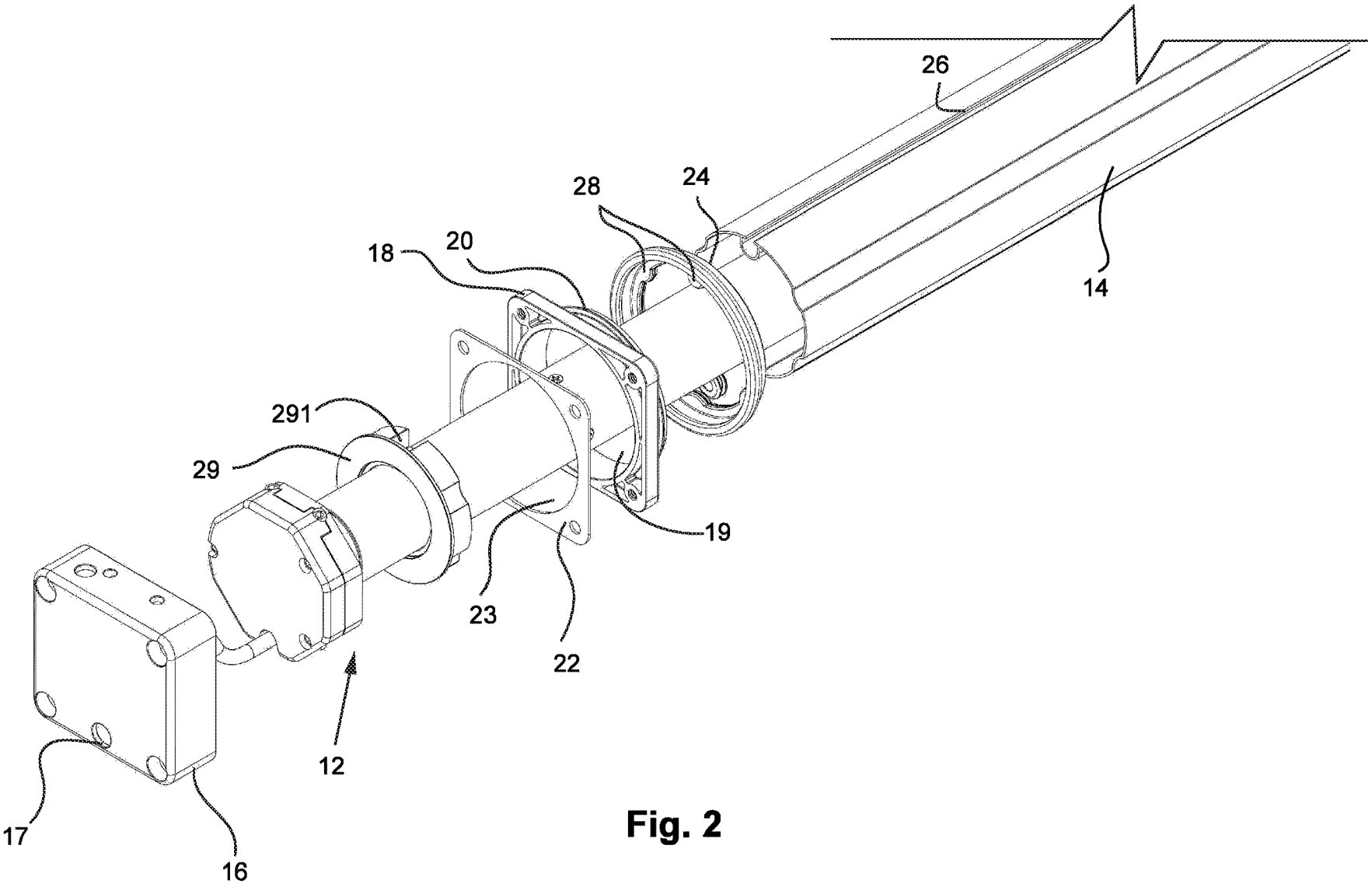
FIG. 2 is an exploded perspective view of the seal enclosure.

With reference to the drawings, a seal enclosure 10 is provided for a tubular motor 12 that is configured to drive an awning roller 14. The seal enclosure 10 includes a motor box 16 with an exterior shape. The motor box 16 is sized to fit over an end of the tubular motor 12. The motor box 16 includes an opening 17 therein for threading wires or a power cord from the tubular motor 12. A motor box extension 18 has an outer perimeter corresponding (i.e., substantially identical) to the exterior shape of the motor box 16 as shown in FIG. 1. The motor box extension 18 includes a central opening 19 that is sized to fit over the awning roller 14. The motor box extension 18 also includes a circumferential protrusion 20.

A gasket 22 is positioned between the motor box 16 and the motor box extension 18. As shown, the gasket 22 may have an outer shape corresponding to the exterior shape of the motor box 16. The gasket 22 includes a central opening 23 that is sized corresponding to the central opening 19 of the motor box extension 18. The motor box includes openings as shown for receiving connectors securable through the gasket 22 and the motor box extension 18.

A flexible seal 24 is configured to engage the awning roller 14. The awning roller 14 may be provided with notches 26 or the like, and the flexible seal 24 may be provided with interior tabs 28 that are positioned to engage the notches 26. The flexible seal 24 is thus configured to fit over the awning roller 14 with the tabs 28 engaging the notches 26. The motor box 16, the motor box extension 18 and the flexible seal 24 define a closed housing for the tubular motor 12.

As is conventional with tubular motors, a crown 29 engages an end of the awning roller 14 and serves to center the awning roller 14 about the tubular motor 12. The crown 29 includes corresponding notches 291 for receiving the notches 26 of the awning roller 14 that protrude inside the awning roller 14.

Figure 3:
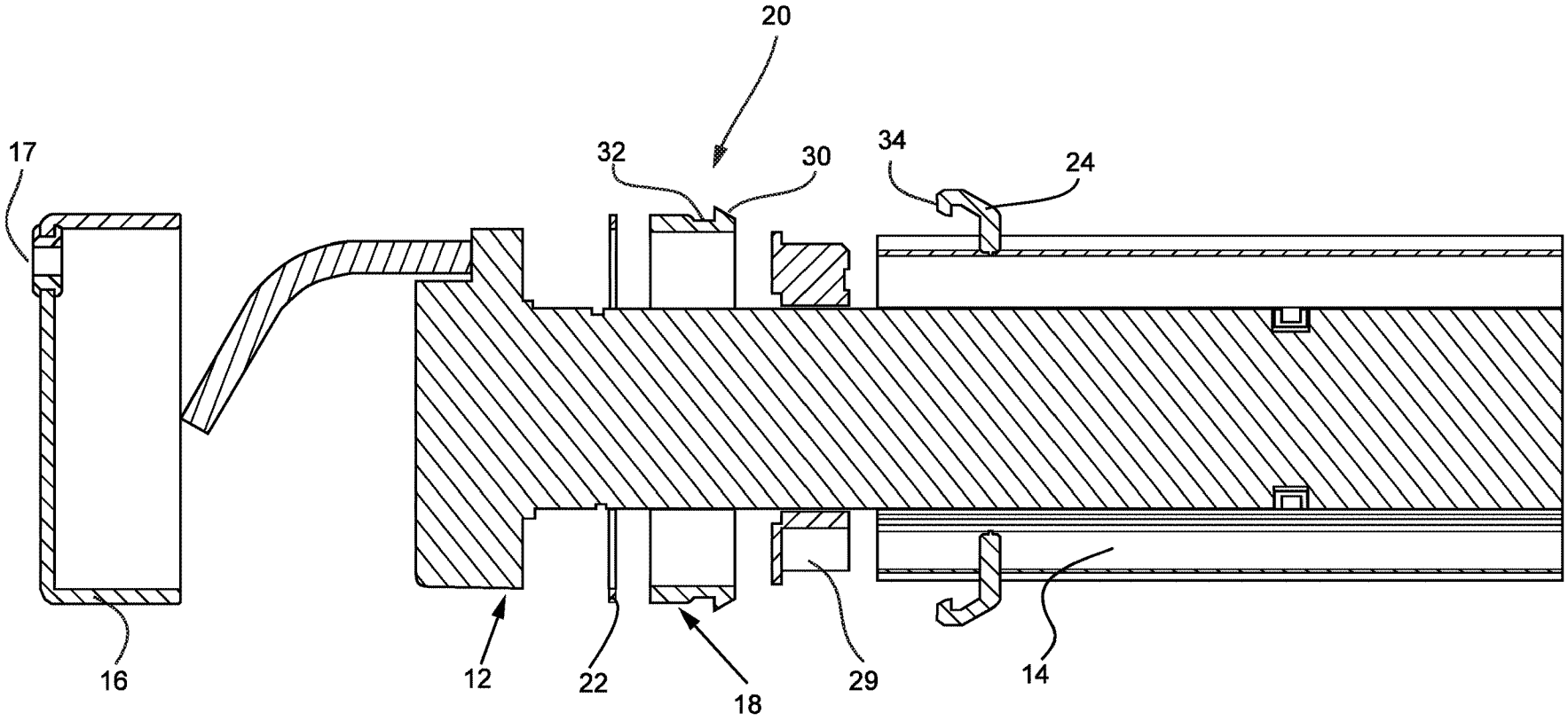
FIG. 3 is an exploded cross-sectional view of the seal enclosure.
Figure 4:
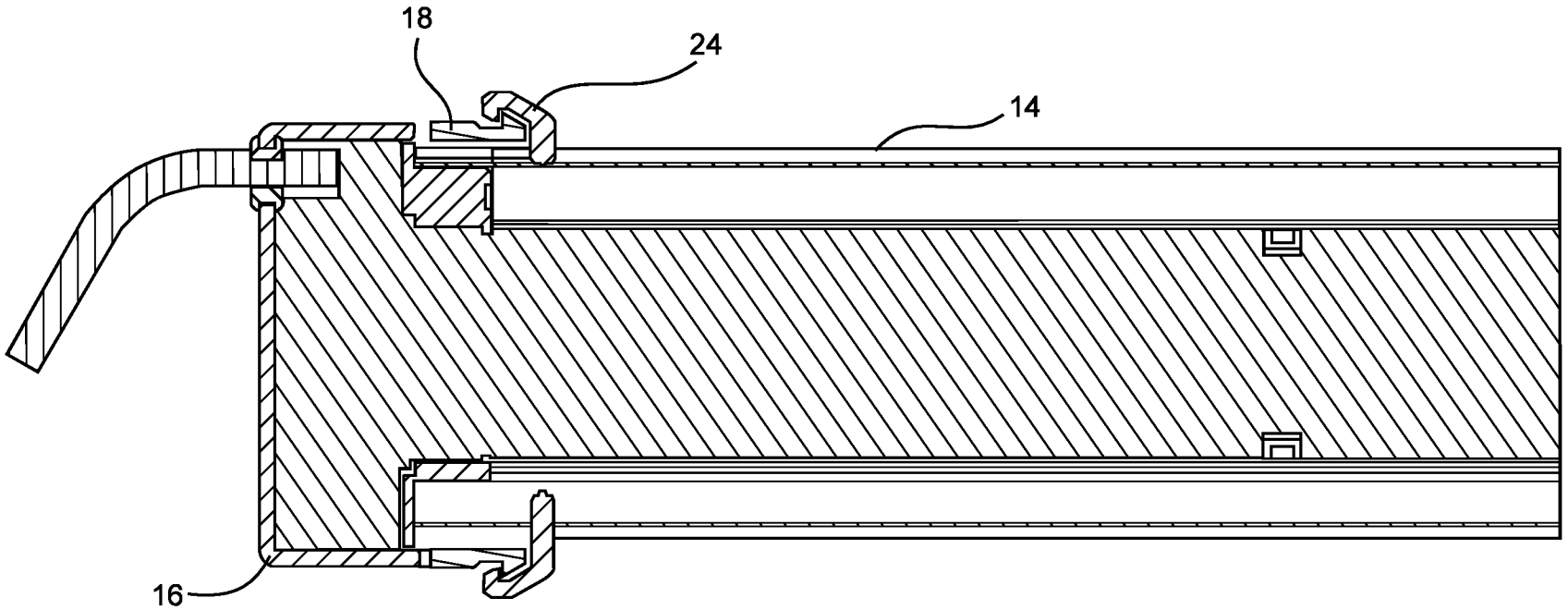
FIG. 4 is a cross-sectional view of the assembled enclosure.

With reference to FIGS. 3 and 4, the circumferential protrusion 20 may be disposed around an exterior surface of the motor box extension 18. As shown, the circumferential protrusion 20 may include an inclined surface 30, where the motor box extension 18 further includes a trough 32 on a motor box side of the circumferential protrusion 20. The flexible seal 24 may be provided with an interior circumferential ridge 34. In assembling the seal enclosure 10, the circumferential ridge 34 is positioned over the inclined surface 30 of the circumferential protrusion 20 into engagement with the trough 32.

The seal enclosure of the described embodiments serves to seal the tubular motor from the elements to thereby make the motor more dust, water and corrosion resistant. The assembly utilizes components to protect the motor from the elements while still allowing for the full function of the motor/tube assembly. The design utilizes the rotary seal, motor box, motor box/seal interface and roll-up tube gasket to interface with the tubular motor and roll-up tube assembly to increase the Ingress Protection rating while still allowing for normal operation.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A seal enclosure for a tubular motor that is configured to drive an awning roller, the seal enclosure comprising:

a motor box having an exterior shape and sized to fit over an end of the tubular motor, the motor box being configured to at least partially enclose the tubular motor;

a motor box extension having an outer perimeter at a proximal end substantially identical to the exterior shape, wherein the motor box extension includes a circumferential protrusion axially spaced from the proximal end that protrudes radially outward relative to the outer perimeter;

a gasket sandwiched between the motor box and the motor box extension such that the motor box and the motor box extension are separated by the gasket; and a flexible seal engaging the circumferential protrusion of the motor box extension and configured to engage the awning roller for rotation with the awning roller, the flexible seal being axially spaced from the motor box and engaging the motor box extension from a radial exterior of the motor box extension.

2. The seal enclosure according to claim 1, wherein the motor box extension comprises a first central opening that is sized to fit over the awning roller.

3. The seal enclosure according to claim 2, wherein the gasket comprises a second central opening that is sized corresponding to the first central opening.

4. The seal enclosure according to claim 1, wherein the gasket has an outer shape corresponding to the exterior shape of the motor box.

5. The seal enclosure according to claim 1, wherein the circumferential protrusion is disposed around an exterior surface of the motor box extension.

6. The seal enclosure according to claim 5, wherein the circumferential protrusion comprises an inclined surface, and wherein the motor box extension further comprises a trough on a motor box side of the circumferential protrusion.

7. The seal enclosure according to claim 6, wherein the flexible seal comprises an interior circumferential ridge, and wherein the interior circumferential ridge is positioned over the inclined surface into engagement with the trough.

8. A motorized awning roller assembly comprising:

an awning roller;

a tubular motor coupled with the awning roller to drive the awning roller, and a seal enclosure, including:

a motor box having an exterior shape and sized to fit over an end of the tubular motor, the motor box enclosing the end of the tubular motor, a motor box extension having an outer perimeter at a proximal end substantially identical to the exterior shape, wherein the motor box extension includes a circumferential protrusion axially spaced from the proximal end that protrudes radially outward relative to the outer perimeter, a gasket sandwiched between the motor box and the motor box extension such that the motor box and the motor box extension are separated by the gasket, and a flexible seal engaging the circumferential protrusion of the motor box extension and engaging the awning roller for rotation with the awning roller, the flexible seal being axially spaced from the motor box and engaging the motor box extension from a radial exterior of the motor box extension.

9. The motorized awning roller according to claim 8, wherein the motor box extension comprises a first central opening that is sized to fit over the awning roller.

10. The motorized awning roller according to claim 9, wherein the gasket comprises a second central opening that is sized corresponding to the first central opening.

11. The motorized awning roller according to claim 8, wherein the gasket has an outer shape corresponding to the exterior shape of the motor box.

12. The motorized awning roller according to claim 8, wherein the circumferential protrusion is disposed around an exterior surface of the motor box extension.

13. The motorized awning roller according to claim 12, wherein the circumferential protrusion comprises an inclined surface, and wherein the motor box extension further comprises a trough on a motor box side of the circumferential protrusion.

14. The motorized awning roller according to claim 13, wherein the flexible seal comprises an interior circumferential ridge, and wherein the interior circumferential ridge is positioned over the inclined surface into engagement with the trough.

* * * * *